US009156639B1

(12) United States Patent
Inoue

(10) Patent No.: US 9,156,639 B1
(45) Date of Patent: Oct. 13, 2015

(54) SHEET CONVEYING APPARATUS AND IMAGE FORMING APPARATUS

(71) Applicant: CANON KABUSHIKI KAISHA, Tokyo (JP)

(72) Inventor: Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/644,366

(22) Filed: Mar. 11, 2015

(30) Foreign Application Priority Data

Mar. 19, 2014 (JP) ..... 2014-056387

(51) Int. Cl.
*B65H 5/02* (2006.01)
*B65H 5/04* (2006.01)
*B65H 5/06* (2006.01)

(52) U.S. Cl.
CPC ..... *B65H 5/068* (2013.01); *B65H 5/062* (2013.01); *B65H 2402/45* (2013.01); *B65H 2404/144* (2013.01); *B65H 2404/152* (2013.01); *B65H 2404/15212* (2013.01)

(58) Field of Classification Search
CPC .... B65H 5/062; B65H 5/068; B65H 2402/45; B65H 2404/144; B65H 2404/152; B65H 2404/15212
See application file for complete search history.

(56) References Cited

U.S. PATENT DOCUMENTS 4,850,584 A * 7/1989 Watashi ..... 271/274
5,203,217 A * 4/1993 Buckley ..... 74/500.5
5,358,230 A 10/1994 Ikemori et al.
5,485,991 A 1/1996 Hirano et al.
5,600,426 A * 2/1997 Gramlich et al. ..... 399/381
5,793,399 A 8/1998 Kawakami et al.
5,867,196 A 2/1999 Kiyohara et al.
5,886,729 A 3/1999 Hiramatsu et al.
5,992,993 A 11/1999 Kiyohara et al.
6,045,220 A 4/2000 Kiyohara et al.
8,292,293 B2 10/2012 Inoue
8,480,081 B2 7/2013 Inoue
8,550,456 B2 10/2013 Hirota et al.
8,807,562 B2 * 8/2014 Yamaguchi ..... 271/273
8,867,980 B2 10/2014 Inoue
2007/0069456 A1 * 3/2007 Jeong ..... 271/272
2012/0075681 A1 3/2012 Inoue
2014/0035225 A1 * 2/2014 Kondo ..... 271/274
2014/0191469 A1 * 7/2014 Tamura ..... 271/272
2015/0104203 A1 * 4/2015 Goto et al. ..... 399/20

FOREIGN PATENT DOCUMENTS

JP 06-144633 A 5/1994

* cited by examiner

*Primary Examiner* — Prasad Gokhale
(74) *Attorney, Agent, or Firm* — Fitzpatrick, Cella, Harper & Scinto

(57) ABSTRACT

A sheet conveying apparatus includes a conveying guide configured to guide a sheet which is conveyed by a conveying roller and a driven roller, a pressing spring configured to press the driven roller toward the conveying roller, a holding portion configured to be provided to be rotated about a shaft center of the driven roller and to receive a pressing force of the pressing spring, and a supporting portion configured to support the driven roller in a direction perpendicular to a sheet conveying direction to abut on or be separated from the conveying roller. The holding portion includes a facing portion which is disposed to face the conveying guide. The facing portion is separated from the conveying guide in a state where the driven roller abuts on the conveying roller. The facing portion abuts on the conveying guide when the driven roller is separated from the conveying roller.

14 Claims, 10 Drawing Sheets

SHEET CONVEYING APPARATUS AND IMAGE FORMING APPARATUS

BACKGROUND OF THE INVENTION

1. Field of the Invention

The present invention relates to a sheet conveying apparatus which conveys a sheet, and an image forming apparatus which is provided with the sheet conveying apparatus.

2. Description of the Related Art

In recent years, when an image forming apparatus such as a printer or a copying machine performs a printing operation, a wide variety of sheets are used depending on purposes. In particular, there has been increasing demand for a thick sheet used in packages made of a boxing material as a wide variety of sheets, but the sheet has a problem in that rigidity is large and sheet clogging easily occurs. Therefore, as a countermeasure, a radius R of a bending portion in a conveying path is made large, resistance exerted from a conveying guide when the sheet is conveyed is reduced, and a nip pressure of a conveying roller is significantly increased to raise a conveying force.

Furthermore, in order to comply with the demand for the wide variety of sheets, space saving of installation area for the apparatus or cost saving is also increasingly demanded. However, when the radius R of the bending portion in the conveying path is made large, the apparatus is increased in size to cause the cost to be significantly increased, so that it conflicts with reality. For this reason, the countermeasures of raising the nip pressure of the conveying roller and increasing the conveying force are widely employed.

In addition, as illustrated in FIGS. 10A and 10B, likewise a driven roller 253 which is on a door side to be opened/closed with respect to a main body of the image forming apparatus, a configuration in which a pressing spring 256 is hooked around and presses a driven roller shaft 252 is employed in many products for the space saving and for the low cost (Japanese Patent Laid-Open No. 06-144633).

However, in the configuration illustrated in FIG. 10B, in a case where the nip pressure of the conveying roller is raised, the length of the pressing spring 256 is not possible to be long, so that a spring constant is increased. In this case, since a partial force f0 is generated in a direction of angle θ0 with respect to in a direction of a pressing force F0, a variation in pressure is easily increased still more. Then, since the pressing force is increased, a roller shaft 215*c* of a driving roller 215 or an opening/closing guide 221 is significantly bent, an actual length of the pressing spring 256 is reduced at the time of pressing, the spring constant is increased, and a necessary pressing force is also not obtained.

As illustrated in FIG. 10A, in the opening/closing guide 221 where an opening/closing hinge 227 is provided on a side (herein, an inner side) of a width direction perpendicular to the conveying direction of the sheet, bending on the side (the inner side) of the width direction is different from that on the other side (the front side). For this reason, a difference of the pressing force on the inner side and the front side of the width direction is increased, so that the sheet is fed on the skew.

SUMMARY OF THE INVENTION

An object of the invention is to provide a sheet conveying apparatus and an image forming apparatus which is provided with the same, through which a size can be reduced and a spring constant is reduced, and a spring pressure can be stabilized by suppressing a variation in pressure.

In order to achieve the above object, there is provided a sheet conveying apparatus of the invention. The sheet conveying apparatus includes: a conveying roller configured to be rotated by a driving force; a driven roller configured to be disposed to face the conveying roller and to be rotatably driven by the conveying roller; a conveying guide configured to guide a sheet which is conveyed by the conveying roller and the driven roller; a pressing spring configured to press the driven roller toward the conveying roller; a holding portion configured to be provided to be rotated about a shaft center of the driven roller and to receive a pressing force of the pressing spring; and a supporting portion configured to support the driven roller in a direction perpendicular to a sheet conveying direction so as to abut on or be separated from the conveying roller, wherein the holding portion includes a facing portion which is disposed to face the conveying guide, the facing portion is separated from the conveying guide in a state where the driven roller abuts on the conveying roller, and the facing portion abuts on the conveying guide when the driven roller is separated from the conveying roller.

According to the invention, it is possible to reduce the apparatus in size and reduce the spring constant, and it is possible to make the spring pressure stable by suppressing the variation in pressure. Furthermore, the facing portion of the holding portion can be maintained in substantially parallel to the conveying guide by a frictional force between the holding portion and the pressing spring. In addition, since the spring pressure is stabilized by suppressing the variation in pressure, it is possible to prevent clogging and skew feeding of the sheet.

Further features of the present invention will become apparent from the following description of exemplary embodiments with reference to the attached drawings.

DESCRIPTION OF THE EMBODIMENTS

Hereinafter, exemplary embodiments of the invention will be described in detail with reference to the drawings. However, dimensions, materials, and shapes of the components, and relative arrangements therebetween described in the following embodiments may be appropriately changed according to the configuration and various conditions of the apparatus to which the invention is applied. Therefore, if not otherwise specified, it is not intended to limit the scope of the invention only to these configurations.

Figure 1:
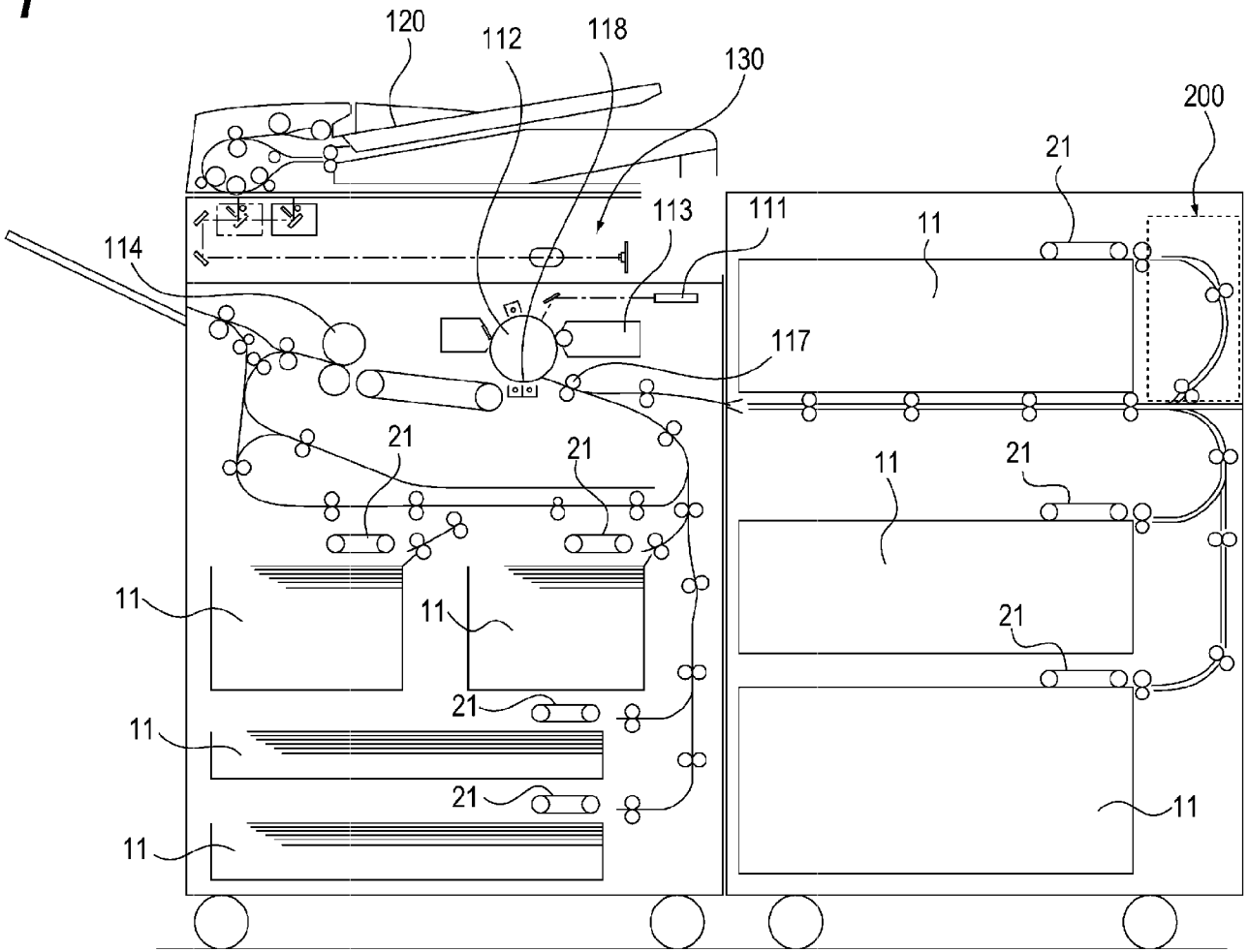
FIG. 1 is a diagram illustrating an image forming apparatus which includes a sheet conveying apparatus according to the invention.

An image forming apparatus which includes a sheet conveying apparatus according to the example will be described using FIG. 1. FIG. 1 is a schematic sectional view of the image forming apparatus which includes the sheet conveying apparatus to which the invention is employed.

First, an original is automatically sent up to a reading position by an auto original feeding portion 120, and image information is read by an image reading portion 130. The read image information is processed by a controller (not illustrated), and a laser beam is emitted from a laser scanner unit 111 according to a signal based on the processing result, and an electrostatic latent image is formed on a photosensitive drum 112.

A sheet feeding apparatus is disposed on the lower side and the right side of the image forming apparatus. The sheet feeding apparatus includes a storage unit 11 which is drawable out of an apparatus body and an air feed type of sheet feeding mechanism which includes a conveying belt 21. A sheet stored in the storage unit 11 is fed to an image forming portion by the sheet feeding mechanism.

In the image forming portion, the electrostatic latent image on the photosensitive drum is developed by a development device 113, and the developed toner image on the photosensitive drum is transferred in a transfer portion 118 onto the sheet which is synchronized in a registration portion 117. Furthermore, the sheet is guided to a pair of fixing rollers 114 to be heated and pressured for the fixation, and then discharged.

Figure 2:
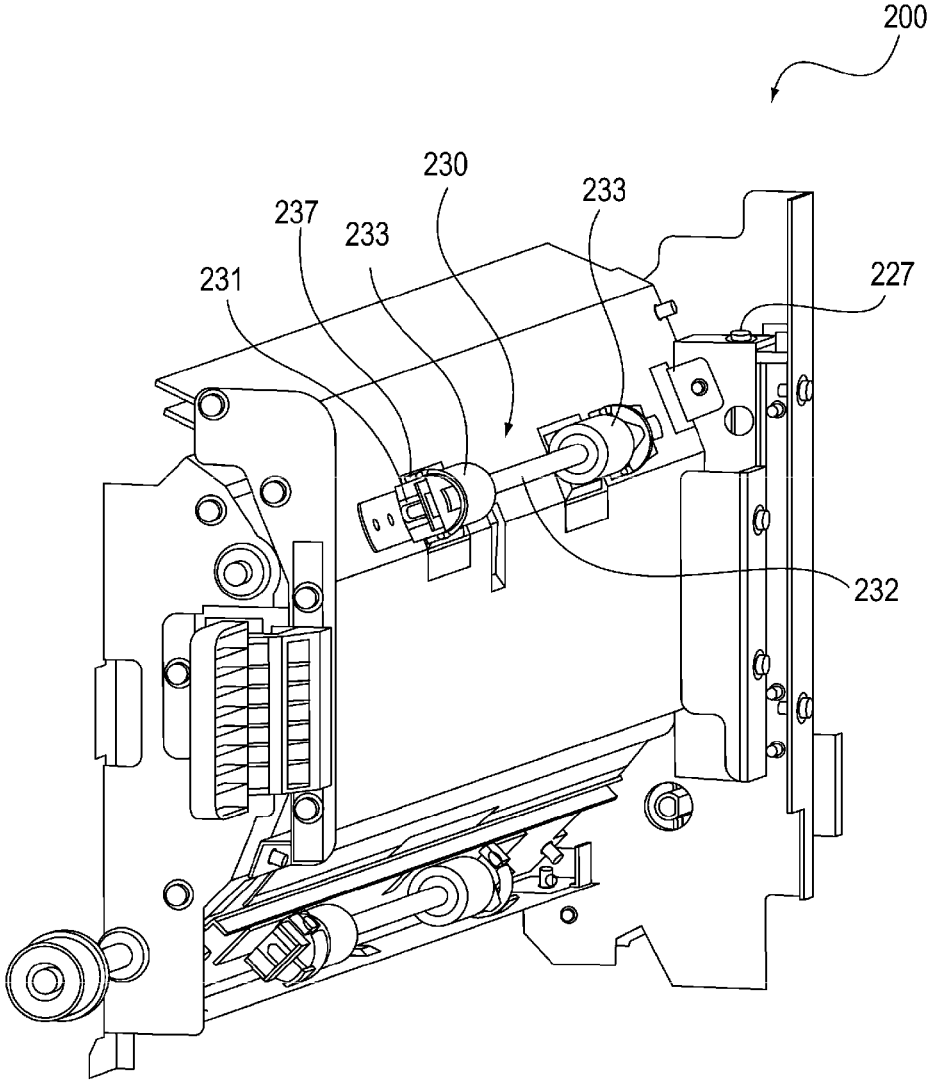
FIG. 2 is a schematic view for describing the sheet conveying apparatus (an opening/closing guide is a closed state) according to the invention.
Figure 3:
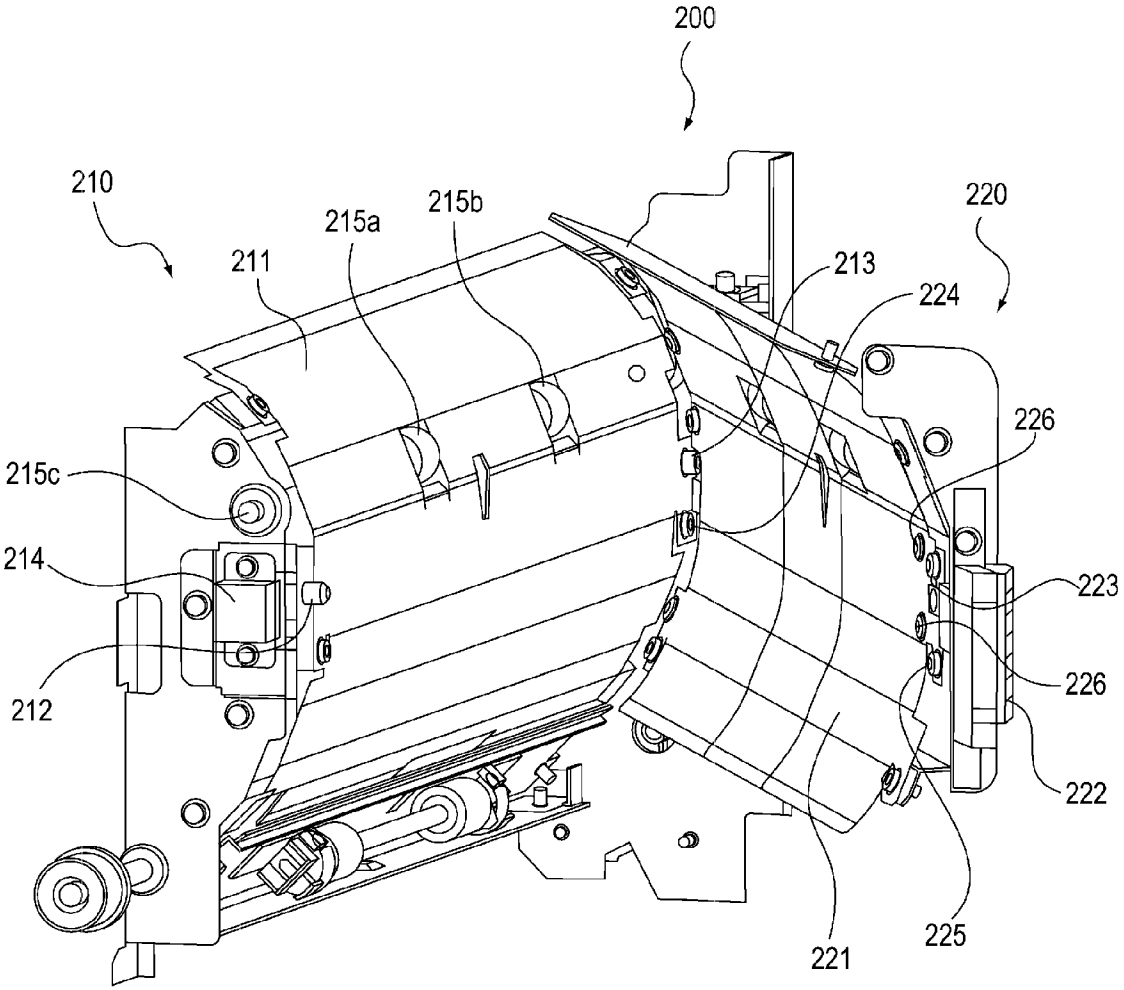
FIG. 3 is a schematic view for describing the sheet conveying apparatus (the opening/closing guide is an opened state) according to the invention.
Figure 4:
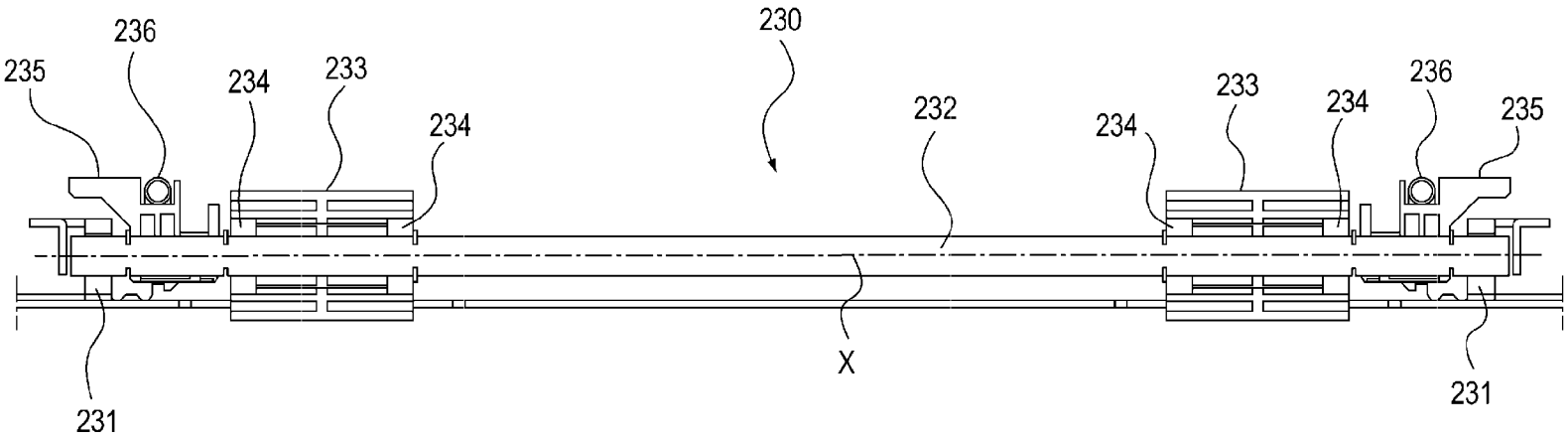
FIG. 4 is a schematic sectional view for describing a driven roller portion of the sheet conveying apparatus according to the invention.

Next, a vertical path conveying unit 200 serving as the sheet conveying apparatus included in the image forming apparatus will be described. A detailed view of the vertical path conveying unit 200 is illustrated in FIG. 2 to FIGS. 5A to 5E. FIGS. 2 and 3 illustrate perspective views of the vertical path conveying unit, FIG. 4 illustrates a cross-sectional view of a driven roller portion, and FIGS. 5A to 5E illustrate schematic views of a pair of rollers. Further, in the following description, an inner side and a front side indicate one side in a width direction perpendicular to a conveyance direction of the sheet and the other side, respectively.

As illustrated in FIGS. 2 and 3, the vertical path conveying unit 200 includes a fixed guide unit 210 and an opening/closing guide unit 220, and is configured such that the opening/closing guide unit 220 is freely opened or closed with respect to the fixed guide unit 210 by an opening/closing hinge 227. In the fixed guide unit 210, a fixed guide 211 serving as a conveying guide which guides the sheet, positioning pins 212 and 213 on the front side and the inner side, and a magnet 214 are provided. In the opening/closing guide unit 220, an opening/closing guide 221 serving as the conveying guide which guides the sheet, a hold 222, bearings 223 and 224 for the positioning on the front side and the inner side, a magnet attracting portion 225, a guide abutment portion 226, and a driven roller portion 230 are provided.

As described above, in the example, one roller (herein, a driving roller 215) is provided in the fixed guide unit, and the other roller (herein, a driven roller 233 of the driven roller portion 230) facing the one roller is provided in the opening/closing guide unit. With this configuration, the opening/closing guide unit is opened and closed with respect to the fixed guide unit, so that the driven roller 233 and the driving roller 215 are configured to abut or be separated.

As illustrated in FIG. 2, when the opening/closing guide unit 220 is closed, the position of the opening/closing guide 221 in the vertical direction (a sheet conveying direction) is determined with respect to the fixed guide unit 210 by the positioning pins 212 and 213 on the front side and the inner side and the bearings 223 and 224 for the positioning on the front side and the inner side. Furthermore, the opening/closing guide 221 is fixed with respect to the fixed guide unit 210 by the magnet 214 and the magnet attracting portion 225. At this time, the position of the magnet 214 is adjusted to make the guide abutment portion 226 abut on the fixed guide 211.

In addition, the driving roller 215 serving as the conveying roller having two rubber portions 215*a* and 215*b* on a metal shaft 215*c* is provided in the fixed guide unit 210, and the driving roller 215 is supported to the fixed guide unit 210 to be rotated. The driving roller 215 is rotated by a driving force from a driving motor (a driving source) which is not illustrated.

As illustrated in FIG. 4, in the driven roller portion 230 of the opening/closing guide unit 220, the driven roller 233 is supported to a driven roller shaft 232 through a bearing 234 to be rotated. The driven roller shaft 232 is supported by the bearing 231 fitted in a U-shaped groove or a long hole formed in the frame to be movable in a direction perpendicular to the sheet conveying direction, so that the driven roller 233 abuts on or is separated from the driving roller 215. In the driven roller shaft 232 of the driven roller 233, a spring holder (holding portion) 235 which receives a pressing force of a pressing spring 236 serving as a pressing portion is supported to be rotated. The pressing spring 236 in the example is a coil spring, both ends thereof are fixed to spring hook portions 237, and a coil portion is fixed to the spring holder 235 to be partially wound. Therefore, the driven roller 233 is pressed toward the driving roller (the pressing direction) by the pressing spring 236 through the spring holder 235. The driven roller 233 is disposed to face the driving roller 215, and is rotatably driven by the driving roller 215 in a state where the driven roller 233 is pressed by the pressing spring 236 and comes into press contact with the driving roller 215. The bearing 231 supports the driven roller 233 to be movable in a direction abutting on or separated from the driving roller 215 and restricts the movement of the driven roller 233 in the sheet conveying direction. The bearing 231 and U-shaped groove (or the long hole) set forth above serve as a supporting portion. Further, in the example, the description has been made about the spring holder 235 is configured to be supported to the driven roller shaft 232 to be rotated, but the spring holder 235 may be configured to be supported to the driven roller 233 to be rotated. In other words, the spring holder 235 may be provided to be rotated about a shaft center X of the driven roller 233.

Figure 5A:
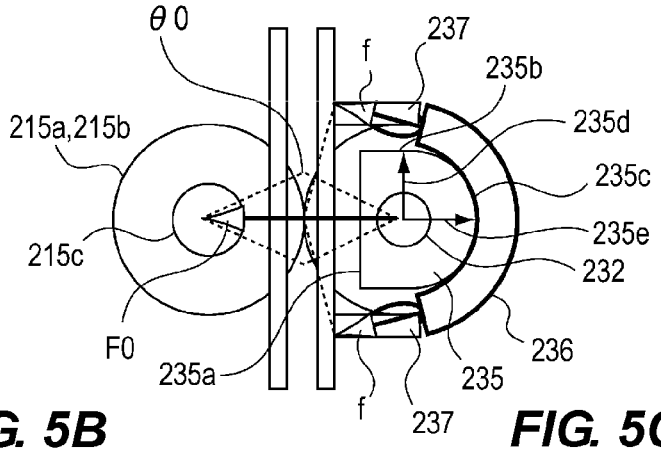
FIGS. 5A to 5E are schematic views for describing the states of a driving roller and a driven roller of the sheet conveying apparatus according to the invention.
Figure 6:
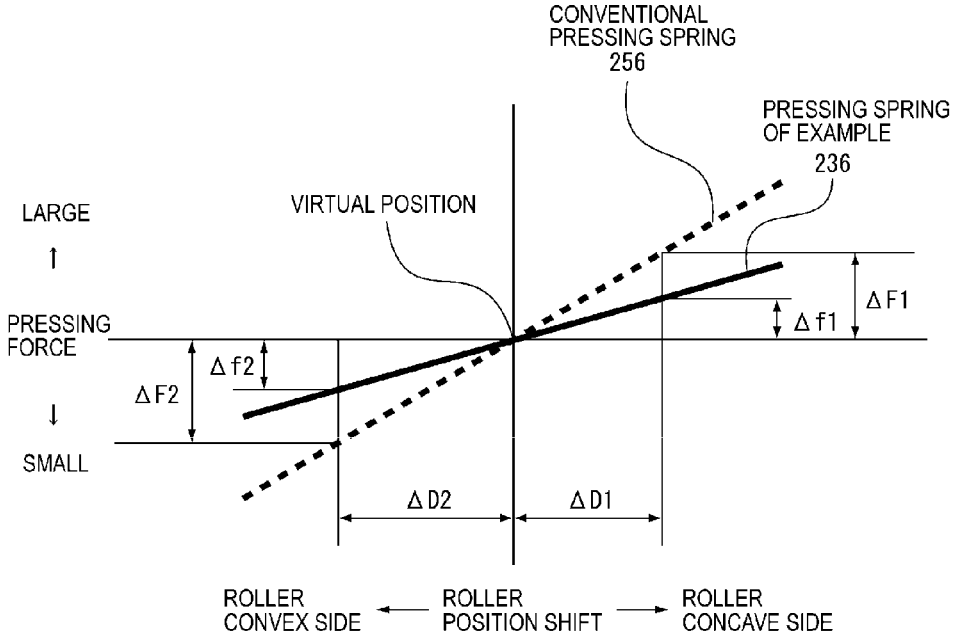
FIG. 6 is a schematic view for describing a variation in conveyance pressure of the sheet conveying apparatus according to the invention.
Figure 10A:
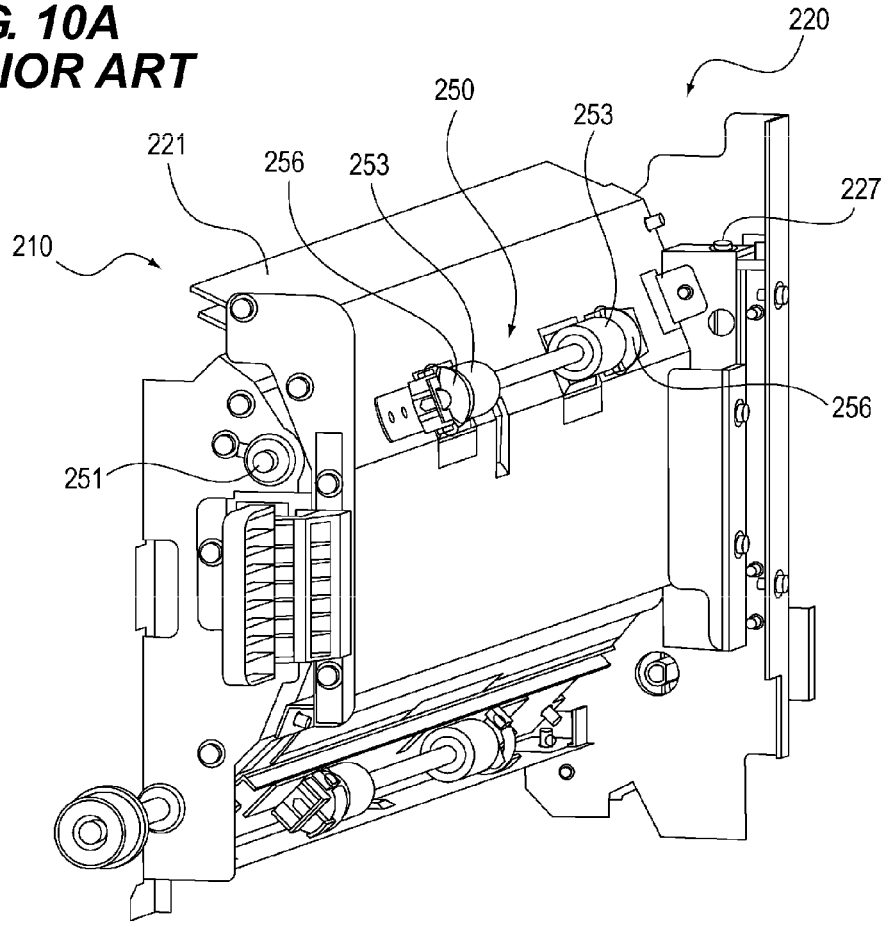
FIG. 10A PRIOR ART
FIGS. 10A and 10B are schematic views for describing a sheet conveying apparatus of the related art.
Figure 10B:
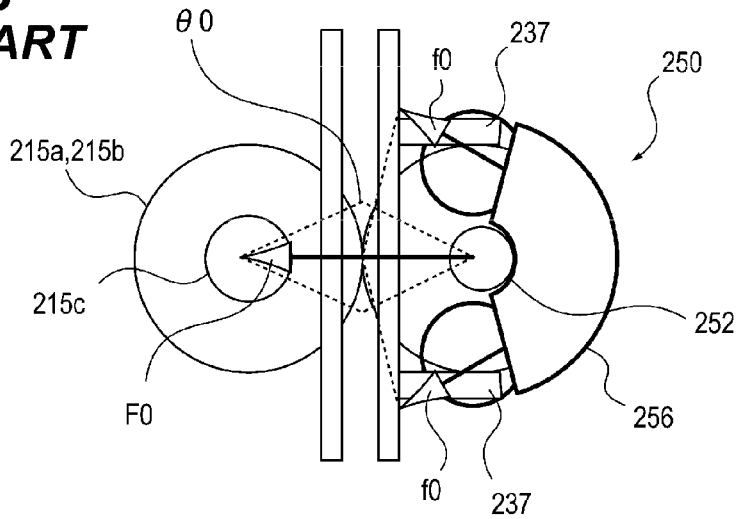
FIG. 10B PRIOR ART

FIG. 6 illustrates a change of the pressing force with respect to a positional change of the driven roller in a case where the pressing spring 236 of the example is used instead of the pressing spring 256 of the related art. FIGS. 10A and 10B illustrate the positions of the driving roller and the driven roller of the related art with respect to the guide. FIG. 5A illustrates the virtual positions of the driving roller and the driven roller with respect to the guide.

Compared to the conventional configuration of pressing a driven roller shaft 252 with the pressing spring 256, the spring holder 235 is rotatably provided in the driven roller shaft 232 in the example, so that the spring holder 235 receives the pressing force of the pressing spring 236 and presses the driven roller 233 toward the driving roller. Therefore, in a case where a nip pressure with respect to the driving roller is raised, compared to the conventional configuration, the spring length can be increased by the above-mentioned spring holder 235, so that a spring constant can be reduced. Furthermore, a partial force is generated in a direction forming an angle θ (smaller than the conventional angle θ0) with respect to a direction of a pressing force F0. Since the partial force is a partial force f smaller than the conventional partial force f0, it is possible to suppress a variation in nip pressure with respect to the driving roller. In addition, since the spring holder 235 has no influence on the bearing 231, a variation in frictional resistance does not occur in the pressing direction and the pressing force becomes stable.

Figure 5B:
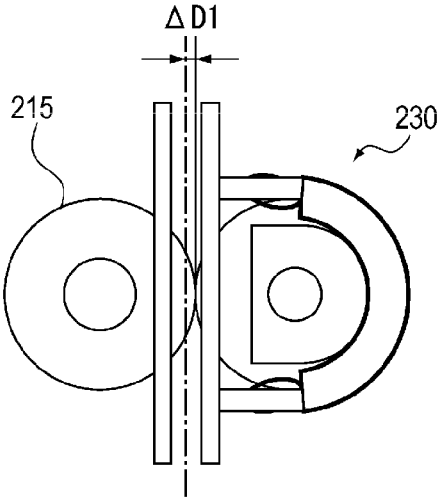

FIG. 5B illustrates a case where the driving roller 215 is shifted toward the driven roller portion 230, the pressing spring 236 is extended, and the pressing force is increased. When setting a shift amount at this time to ΔD1 in FIG. 6, it can be seen that a shift amount Δf1 of the pressing force of the pressing spring 236 of the example is significantly reduced compared to a shift amount ΔF1 of the pressing force of the conventional pressing spring 256.

Figure 5C:
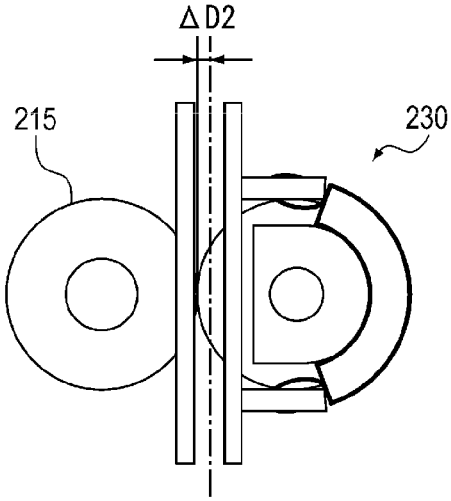

Contrarily, FIG. 5C illustrates a case where the driving roller 215 is shifted to a side away from the driven roller portion 230 by bending of a driving roller shaft 215*c*, the pressing spring 236 is compressed, and the pressing force is reduced. When setting a shift amount at this time to ΔD2 in FIG. 6, it can be seen that a shift amount Δf2 of the pressing force of the pressing spring 236 of the example is significantly reduced compared to a shift amount ΔF2 of the pressing force of the conventional pressing spring 256.

Further, as illustrated in FIG. 5A, the spring holder 235 includes a flat-shaped facing portion 235*a* which faces the opening/closing guide 221, a flank 235*b* of the spring hook portion, and an arc-shaped spring receiving portion 235*c* which receives the pressing force of the pressing spring 236. In the spring holder 235, the facing portion 235*a* is provided to face the opening/closing guide 221 on a side opposite to the spring receiving portion 235*c* (an arc-shaped portion) through a rotation center (the shaft 232). Herein, the facing portion 235*a* is formed in a flat surface along a rear surface (a surface on the rear side of the guide surface for guiding the sheet) of the opening/closing guide 221, and is substantially parallel to the rear surface of the opening/closing guide 221. When a first dimension 235*d* is set from the rotation center of the spring holder 235 to the flank 235*b* in the sheet conveying direction and a second dimension 235*e* is set from the rotation center to a vertex of the peripheral surface of the spring receiving portion 235*c* in a direction (the pressing direction) perpendicular to the sheet conveying direction, the spring holder 235 has a dimensional relation of "235*e*>235*d*".

Figure 5D:
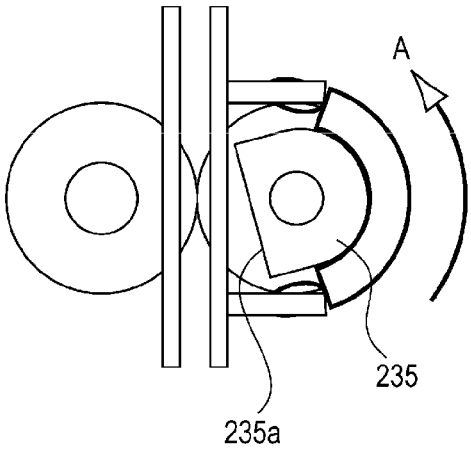
Figure 5E:
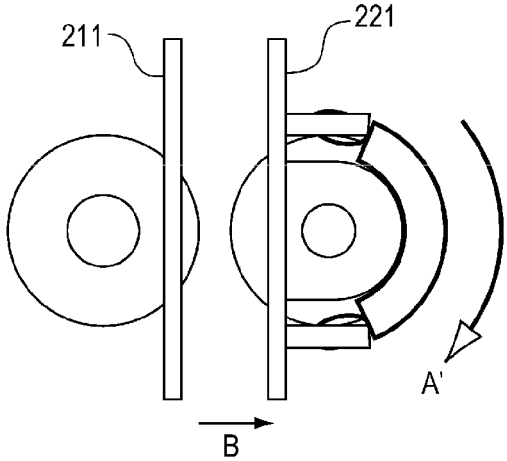

FIG. 5D illustrates a state where the spring holder 235 is rotated in a direction of arrow A due to a sheet clogging (sheet jamming). From this state, when the opening/closing guide 221 is opened in a direction of arrow B as illustrated in FIG. 5E, the driven roller 233 is separated from the driving roller. At this time, the spring holder 235 is pushed toward the driving roller by the pressing spring 236, and the facing portion 235*a* is rotated in a direction of arrow A' to be aligned with the opening/closing guide 221. Then, when the opening/closing guide 221 is closed again from the state illustrated in FIG. 5E, the facing portion 235*a* enters a pressed state while being substantially parallel to the opening/closing guide 221 by a frictional force between the spring holder 235 and the pressing spring 236 as illustrated in FIG. 5A.

As described above, since the spring holder 235 is provided in the driven roller 233 to receive the pressing force of the pressing spring 236, the size can be reduced and the spring constant of the pressing spring 236 can also be reduced, and it is possible to make a spring pressure stable by suppressing a variation in pressure. In addition, with such a configuration of a less variation in pressure, clogging and skew feeding of the sheet can be prevented, and the operability of the opening/closing guide can also be improved. Furthermore, when the facing portion 235*a* of the spring holder 235 abuts on the opening/closing guide 221, the facing portion 235*a* of the spring holder 235 can be substantially parallel to the opening/closing guide 221 by the frictional force between the spring holder 235 and the pressing spring 236.

Figure 7:
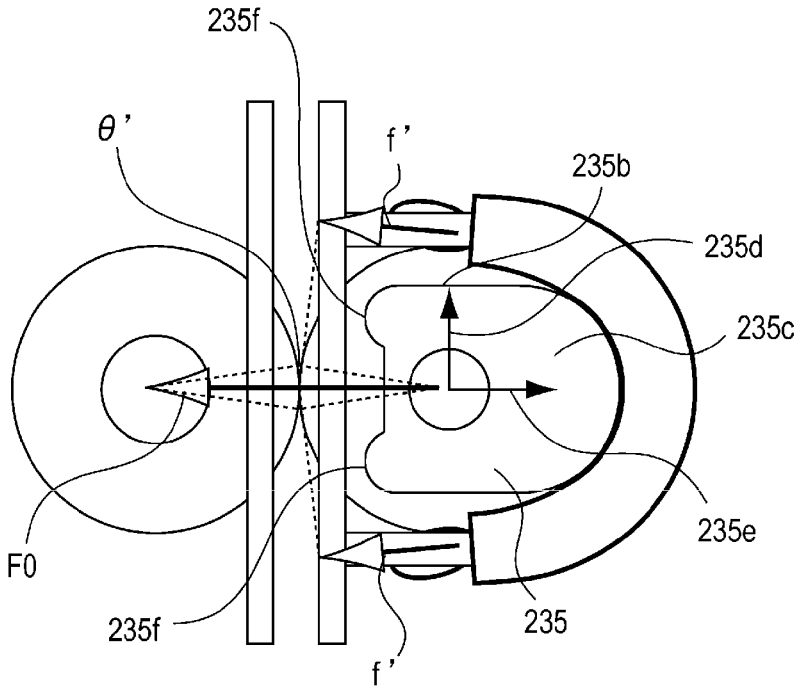
FIG. 7 is a schematic view for describing another example of the sheet conveying apparatus according to the invention.

In the example described above, the flat portion facing the opening/closing guide 221 of the spring holder 235 is formed as the facing portion, but the invention is not limited thereto. For example, as the facing portion, two protruding portions 235*f* may be provided to abut on the opening/closing guide 221 as illustrated in FIG. 7. The number of protruding portions 235*f* is not limited to "2", and at least two portions may be provided. In a case where three or more protruding portions are provided, the tip of each protruding portion is formed to abut on the opening/closing guide 221. In other words, in a case where the opening/closing guide 221 enters the state of FIG. 5D when being opened, the protruding portion 235*f* may be configured to abut on the opening/closing guide 221 to return to the state of FIG. 5E. Further, it is possible to make the spring constant small still more by significantly changing a dimensional relation "235*e*>235*d*" between the first dimension 235*d* from the rotation center of the spring holder (holding portion) 235 to the peripheral surface in the sheet conveying direction and the second dimension 235*e* from the rotation center to the peripheral surface in the pressing direction. Furthermore, since a partial force is generated in a direction of angle θ' smaller than the conventional angle θ0 compared to the direction of the pressing force F0 and becomes a partial force f' smaller than the conventional partial force f0, it is possible to significantly suppress the variation in pressure.

Figure 8:
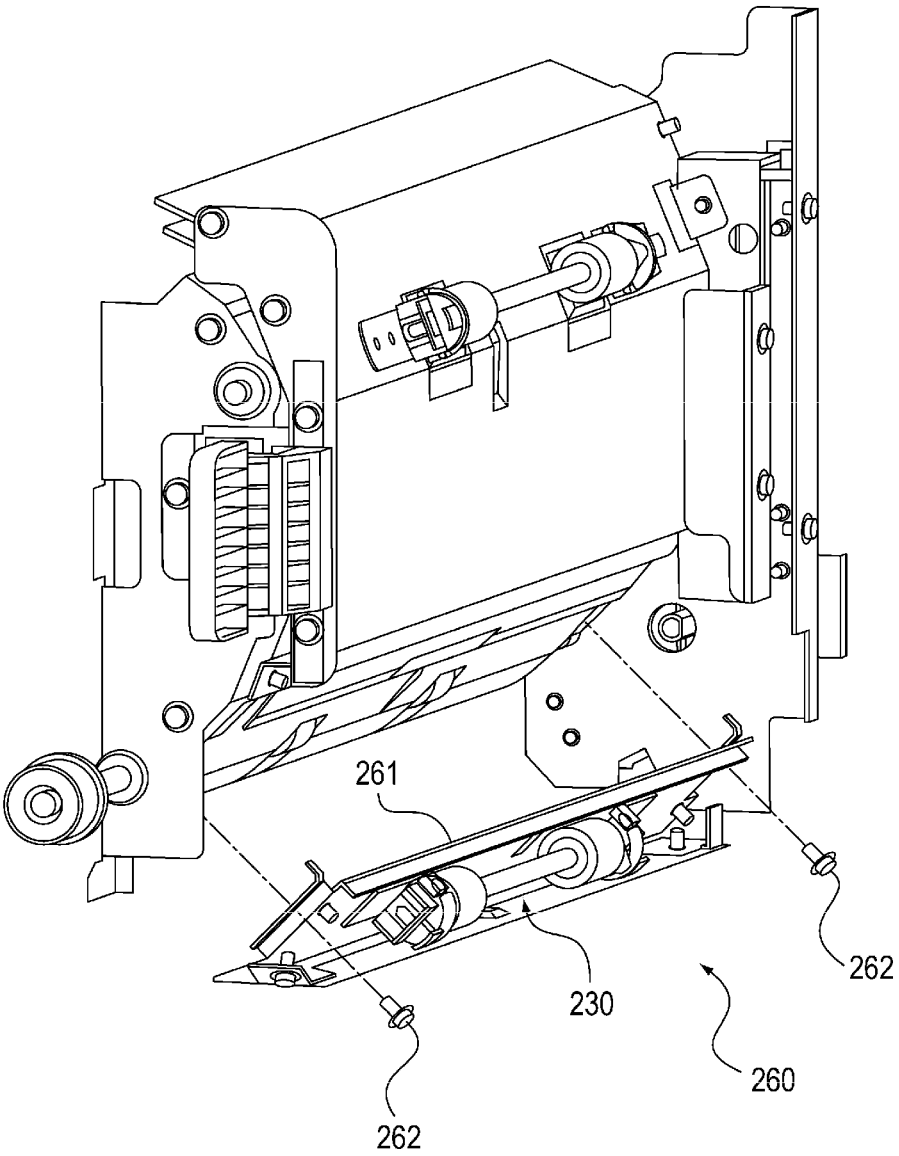
FIG. 8 is a schematic view for describing another example of the sheet conveying apparatus according to the invention.

In addition, in the example described above, the description has been made about the opening/closing guide unit 220, but the invention is not limited thereto. For example, as illustrated in FIG. 8, the invention may be applied to a conveying unit (the sheet conveying apparatus) which is configured to fasten a detachable guide unit 260 by a fixing screw 262 to be detachably attachable to the fixed guide unit. The detachable guide unit 260 includes the driven roller portion 230 which has the same configuration as that of the example described above. In the detachable guide unit 260, the facing portion 235*a* of the driven roller portion 230 is assembled to a detachable guide 261 to face each other. In this case, before a service man assembles the detachable guide unit 260, the facing portion 235*a* facing the spring holder (holding portion) 235 comes into close contact with the detachable guide 261 to be aligned (that is, the state of FIG. 5E). When the detachable guide unit 260 is screwed, (that is, the state of FIG. 5A) the facing portion 235*a* enters a pressed state while being substantially parallel to the detachable guide 261 by the frictional force between the spring holder 235 and the pressing spring 236. Therefore, the same effect as the example described above is achieved even in this example.

Figure 9A:
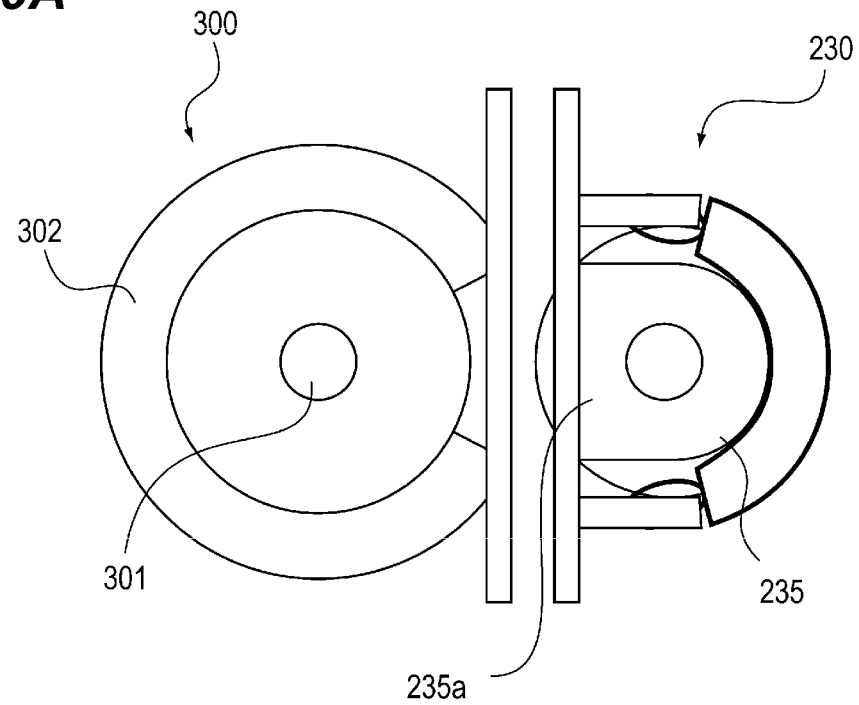
FIGS. 9A and 9B are schematic views for describing another example of the sheet conveying apparatus according to the invention.
Figure 9B:
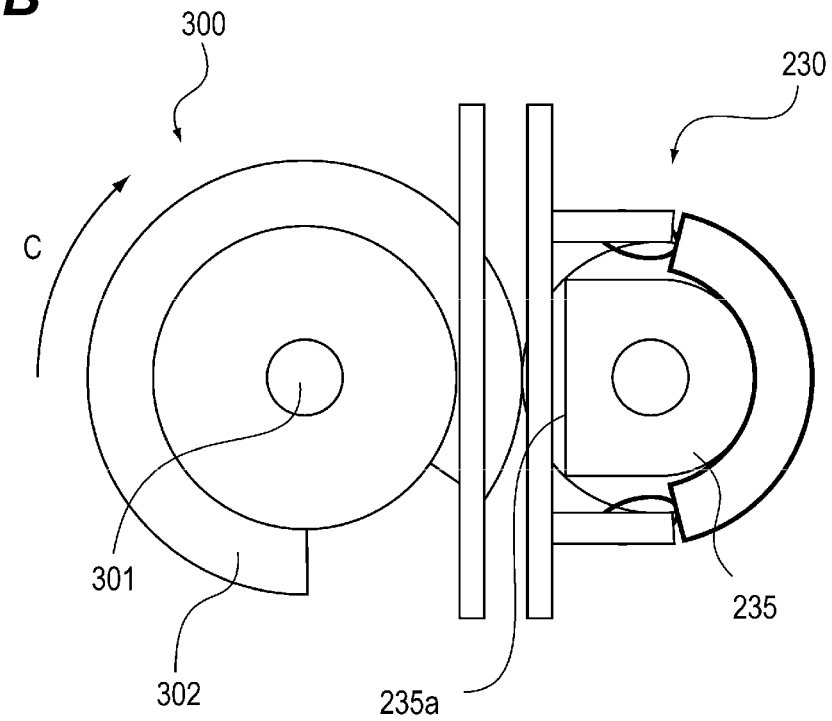

In addition, in the example described above, the description has been made about the configuration in which the opening/closing guide moves, but the invention may be applied to a configuration in which the driving roller moves as illustrated in FIGS. 9A and 9B. A driving roller 300 includes a driving roller shaft 301, a roller conveying surface 302 which is the peripheral surface facing the driven roller, and a notch portion 303 which is formed in a part of the roller conveying surface 302. As illustrated in FIG. 9A, when the driven roller portion 230 comes to face the notch portion 303 of the driving roller 300, the driven roller portion 230 is pressed toward the driving roller 300. Therefore, the facing portion 235*a* of the spring holder (holding portion) 235 comes into close contact with the opening/closing guide 221 to be aligned. On the other hand, as illustrated in FIG. 9B, when the driving roller 300 is rotated in a direction of arrow C, the driven roller portion 230 is pushed up to a side opposite to the pressing direction by the roller conveying surface 302, the facing portion 235*a* enters a pressed state while being substantially parallel to the opening/closing guide 221 by the frictional force between the spring holder 235 and the pressing spring 236. Therefore, the same effect as that of the example described above is achieved even in this example.

In addition, in the example described above, the description has been made about the copying machine as an image forming apparatus, but the invention is not limited thereto. For example, another image forming apparatus such as a scanner, a printer, and a facsimile machine, or other image forming apparatuses such as a multifunction peripheral obtained by combining these functions may be employed. The same effect can be achieved by applying the invention to the sheet conveying apparatus which is used in these image forming apparatuses.

In addition, in the example described above, the description has been made about the vertical path conveying unit 200 as the sheet conveying apparatus included in the image forming apparatus, but the invention is not limited thereto. The invention is effectively applied to another sheet conveying apparatus which is included in the image forming apparatus.

In addition, in the example described above, the description has been made about the sheet conveying apparatus which conveys a sheet such as a recording sheet as a recording target, but the invention is not limited thereto. For example, the same effect can be achieved by applying the invention to a sheet conveying apparatus which conveys a sheet such as an original as a reading target.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-056387, filed Mar. 19, 2014, which is hereby incorporated by reference herein in its entirety.

What is claimed is:

1. A sheet conveying apparatus comprising:

a conveying roller configured to be rotated by a driving force;

a driven roller disposed facing the conveying roller and configured to be rotatably driven by the conveying roller;

a conveying guide configured to guide a sheet which is conveyed by the conveying roller and the driven roller;

a pressing spring configured to press the driven roller toward the conveying roller;

a holding portion configured to be rotatable about a shaft center of the driven roller and to receive a pressing force of the pressing spring; and a supporting portion configured to support the driven roller so as to abut on or be separated from the conveying roller, wherein the holding portion includes a facing portion which is disposed to face the conveying guide, the facing portion is separated from the conveying guide in a state where the driven roller abuts on the conveying roller, and the facing portion abuts on the conveying guide in a state that the driven roller is separated from the conveying roller.

2. The sheet conveying apparatus according to claim 1, wherein the facing portion of the holding portion is formed in a flat surface which abuts on the conveying guide.

3. The sheet conveying apparatus according to claim 1, wherein the facing portion of the holding portion includes at least two protruding portions which abut on the conveying guide.

4. The sheet conveying apparatus according to claim 1, wherein a second dimension of the holding portion in a direction perpendicular to the sheet conveying direction from a rotation center is larger than a first dimension in the sheet conveying direction from the rotation center.

5. The sheet conveying apparatus according to claim 1, wherein the pressing spring is a coil spring, and a coil portion of the coil spring is provided to partially wind around the holding portion.

6. The sheet conveying apparatus according to claim 1, wherein the conveying guide includes a fixed guide which is provided with the conveying roller and an opening and closing guide which is provided with the driven roller and opened and closed with respect to the fixed guide, and wherein the driven roller is separated from the conveying roller when the opening and closing guide is opened with respect to the fixed guide.

7. The sheet conveying apparatus according to claim 1, wherein the conveying guide includes a fixed guide which is provided with the conveying roller and a detachable guide which is provided with the driven roller and detachably attachable with respect to the fixed guide, and wherein the driven roller is separated from the conveying roller when the detachable guide is opened with respect to the fixed guide.

8. The sheet conveying apparatus according to claim 1, wherein the conveying roller includes a notch portion in a peripheral surface which faces the driven roller, and wherein the driven roller is separated from the conveying roller when the notch portion comes to face the driven roller by rotating the conveying roller.

9. An image forming apparatus comprising:

the sheet conveying apparatus according to claim 1; and an image forming portion configured to form an image on a sheet which is conveyed by the sheet conveying apparatus.

10. A sheet conveying apparatus comprising:

a conveying roller configured to be rotated by a driving force;

a driven roller disposed facing the conveying roller and configured to be rotatably driven by the conveying roller;

a conveying guide configured to guide a sheet which is conveyed by the conveying roller and the driven roller;

a supporting portion configured to support the driven roller in a direction perpendicular to a sheet conveying direction so as to abut on or be separated from the conveying roller; and a pressing portion configured to press the driven roller toward the conveying roller, wherein the pressing portion includes:

a holding portion which is provided to rotate about a shaft center of the driven roller, formed with a facing portion, and formed with an arc-shaped portion on a side opposite to the facing portion, the facing portion being separated from the conveying guide in a state where the driven roller abuts on the conveying roller and abutting on the conveying guide in a state where the driven roller is separated from the conveying roller; and a coil spring of which both end portions are attached to the conveying guide and a coil portion partially winds around the arc-shaped portion of the holding portion.

11. The sheet conveying apparatus according to claim 10, wherein the facing portion of the holding portion is formed in a flat surface which abuts on the conveying guide.

12. The sheet conveying apparatus according to claim 10, wherein the facing portion of the holding portion includes at least two protruding portions which abut on the conveying guide.

13. The sheet conveying apparatus according to claim 10, wherein a second dimension of the holding portion from a rotation center to a vertex of the arc-shaped portion is larger than a first dimension in the sheet conveying direction from the rotation center.

14. An image forming apparatus comprising:

the sheet conveying apparatus according to claim 10; and an image forming portion configured to form an image on a sheet which is conveyed by the sheet conveying apparatus.

* * * * *